United States Patent [19]

Mussack

[11] Patent Number: 4,995,373

[45] Date of Patent: Feb. 26, 1991

[54] CABLE AND BOWSTRING RETAINER ARRANGEMENT FOR COMPOUND ARCHERY BOW

[75] Inventor: Kevin R. Mussack, Clifton Springs, N.Y.

[73] Assignee: Golden Eagle Archery, Inc., Farmington, N.Y.

[21] Appl. No.: 498,965

[22] Filed: Mar. 26, 1990

[51] Int. Cl.[5] ..... F41B 5/00

[52] U.S. Cl. ..... 124/25.6; 124/900

[58] Field of Search ..... 124/23.1, 25, 25.6, 124/900

[56] References Cited

U.S. PATENT DOCUMENTS

| | | | |
|---|---|---|---|
| 3,967,609 | 7/1976 | Frydenlund | 124/25.6 |
| 4,438,753 | 3/1984 | Simonds | 124/25.6 |
| 4,478,203 | 10/1984 | Hayes | 124/25.6 |
| 4,770,154 | 9/1988 | Cook et al. | 124/900 X |
| 4,838,236 | 6/1989 | Kudlacek | 124/900 X |
| 4,886,039 | 12/1989 | Wagner | 124/25.6 |
| 4,926,832 | 5/1990 | Darlington | 124/25.6 |
| 4,926,833 | 5/1990 | Darlington | 124/23.1 |

*Primary Examiner*—Randolph A. Reese
*Assistant Examiner*—Jim Ricci
*Attorney, Agent, or Firm*—Hoffman Stone

[57] ABSTRACT

In a compound bow a pin is carried at one end of the tension cable and fitted through an axial hole in the eccentric wheel at the end of the flexible limb. A peripheral groove is formed in the pin at its end opposite from the cable, and the bowstring is looped around the pin, lying in the groove. The cable lies on one side of the wheel and the bowstring on the opposite side so that the pin is trapped in the hole in the wheel and no additional parts are required for retaining the pin in the wheel.

2 Claims, 1 Drawing Sheet

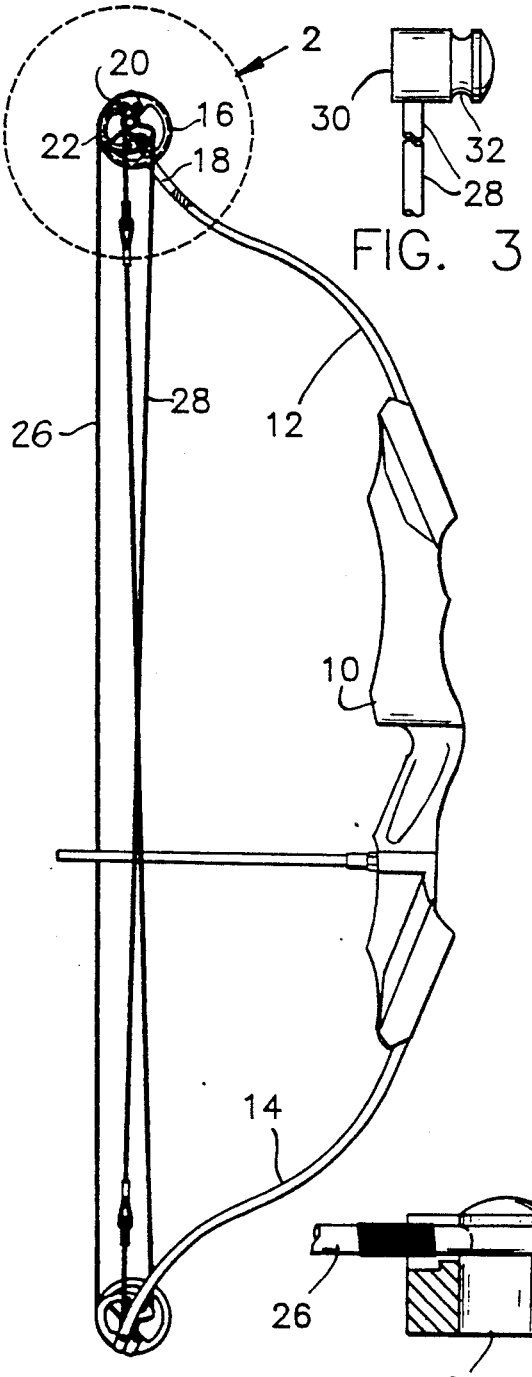
FIG. 1
FIG. 3
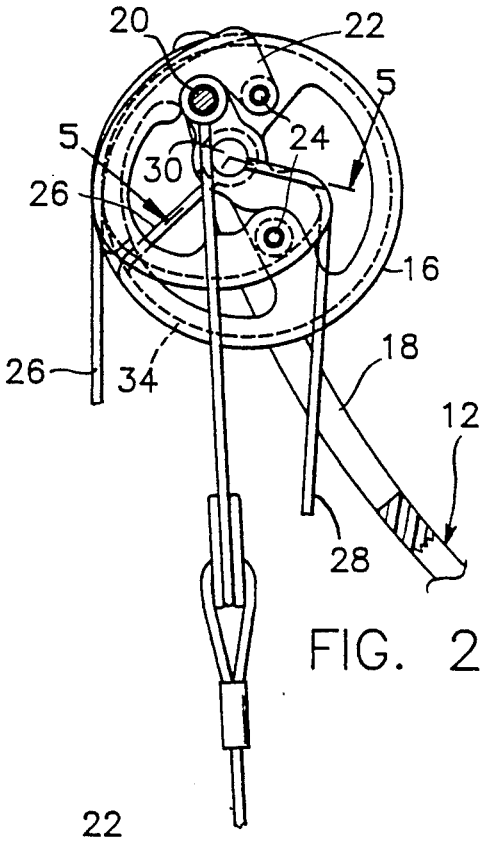
FIG. 2
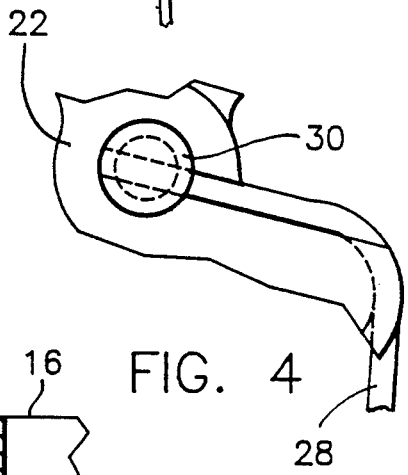
FIG. 4
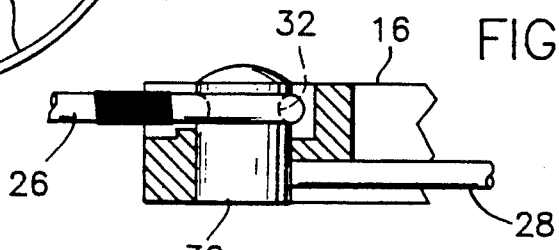
FIG. 5

CABLE AND BOWSTRING RETAINER ARRANGEMENT FOR COMPOUND ARCHERY BOW

This invention relates to a novel compound archery bow, and, more particularly, to a novel arrangement for supporting the bowstring and connecting it to the tension cables.

The problem addressed by the present invention pertains to the manner of terminating the tension cables and attaching the bowstring to them. Heretofore, a bolster of some sort, sometimes referred as a teardrop, was commonly fixed to the end of the tension cable, and an end portion of the bowstring was looped around the bolster. With this arrangement the tension cable would usually break at the bolster if the bow were dry-fired, that is, fired without an arrow or a substitute load to absorb the energy released by the bow. In the practice of the invention this problem is significantly reduced. Also, the number of separate parts in the rigging is reduced, and assembly of the bow, mounting of the tension cables and the bowstring are simplified relative to previous arrangements.

BRIEF DESCRIPTION

Briefly, according to the invention, a metal drum, or pin is die cast upon the end of the tension cable with the cable extending radially from the pin. An annular, circumferential groove is formed in the pin at its end opposite from the cable. The pin is fitted into an axial hole in the draw pulley, or wheel, and the bowstring is looped around its end at the opposite face of the wheel, from the cable, resting in the groove. The arrangement is elegant particularly in that the cable and the bowstring themselves, without the need for any other hardware or parts, serve to retain the pin in place in its hole in the wheel, or pulley, the number of separate parts is reduced relative to previous arrangements, and assembly is appreciably simplified.

DETAILED DESCRIPTION

A representative embodiment of the invention will now be described in conjunction with the drawing, wherein:

FIG. 1 is a side elevational view of a compound bow according to a presently preferred embodiment of the invention;

FIG. 2 is an enlarged view of the rigging at the tip of one limb of the bow as shown in FIG. 1;

FIG. 3 is a side elevational view of the pin as die cast on the end of one of the tension cables of the bow;

FIG. 4 is a greatly enlarged, fragmentary, side elevational view of the retaining pin in the assembly shown in FIG. 3, being an enlargement of a portion of the assembly adjacent to and including the pin 30 in FIG. 2; and FIG. 5 is an enlarged, fragmentary, cross sectional view taken generally along the line 5—5 of FIG. 2.

The invention is shown as embodied in a compound bow of the kind having a handle 10, and a pair of limbs 12 and 14 mounted upon the handle at its respective opposite ends. In the conventional manner a bowstring wheel 16 is mounted within a longitudinal slot 18 at the distal end of the upper limb 12. The wheel is journalled eccentrically on an axle 20, which spans the slot 18 near the tip of the limb, and a cam 22 is removably secured to one face of the wheel 16 as by the screws 24 indicated.

The lower limb 14 is rigged in similar manner as the upper limb 12, the only difference being that the upper and lower wheel and cam arrangements are mutual enantiomorphs.

Both the wheel 16 and the cam 22 are circumferentially grooved to receive the bowstring 26 and the tension cable 28, respectively. A pin 30 is fixed at the end of the tension cable 28 in any desired manner, conveniently being die cast upon the cable. As best seen in FIG. 3, the cable 28 extends radially from the pin 30 near one end of the pin, and a circumferential groove 32 is formed at the end of the pin opposite from the cable. The pin 30 fits in a hole (not separately designated) extending axially through the wheel 16 at a location along a diameter of the wheel about midway between the center of the wheel and the center line of the axle 20.

The end of the bowstring 26 is formed into a loop that fits easily and removably over the tip of the pin 30, lying in the groove 32. The bowstring 26 extends from the pin 30 across the face of the wheel 16 and into the circumferential groove 34 on the rim of the wheel. The tension cable 28 extends from the pin 30 toward the cam 22, and is drawn over the cam as the bow is drawn.

The assembly is self-retaining in that the cable 28 is fixed to the pin 30 and lies on one face of the wheel 16, while the bowstring 26 holds the opposite end of the pin, lying on the face of the wheel opposite from the tension cable. No. separate retaining hardware is required, and the assembly is significantly simplified relative to previously known arrangements.

It will be appreciated that several different rigging arrangements are in use in compound bows. The present arrangement is believed to be readily adaptable to any of the different rigging arrangements without further experiment. The location of the axial hole that receives the pin 30 is not critical, but is simply a matter of designer's choice.

What is claimed is:

1. A retainer arrangement for a compound bow of the kind having a handle, elongated flexible limbs mounted at opposite respective ends of the handle, tension cables for tensioning a bowstring between the distal ends of the limbs, and cam-like rotatable elements at the distal ends of the limbs for receiving terminal portions of the cables and the bowstring, the arrangement comprising cylindrical pins, one of said pins being fixed at the end of each cable extending radially therefrom and having a circumferential groove at its end away from the cable, said pin extending through an axial aperture in one of the rotatable elements and receiving the bowstring in said circumferential groove, when assembled the cable lying on one face of said one rotatable element and the bowstring lying on the opposite face thereby entrapping the pin in the aperture.

2. The retainer arrangement in accordance with claim 1 wherein the pin is die cast upon the end of the cable.

* * * * *